US006006633A

United States Patent [19]

Kaiser et al.

[11] Patent Number: 6,006,633

[45] Date of Patent: Dec. 28, 1999

[54] PLIERS (1)

[75] Inventors: David Kaiser, North Haven; John Killar, Hamden, both of Conn.

[73] Assignee: The Stanley Works, New Britain, Conn.

[21] Appl. No.: 09/112,042

[22] Filed: Jul. 8, 1998

[51] Int. Cl.[6] ..... B25B 7/06

[52] U.S. Cl. ..... 81/387; 81/416; 81/394

[58] Field of Search ..... 81/387, 393, 385, 81/394, 405, 407, 408, 411, 416, 418

[56] References Cited

U.S. PATENT DOCUMENTS

| | | |
|---|---|---|
| 31,849 | 3/1861 | Knapp . |
| D. 56,979 | 1/1921 | Larson . |
| D. 119,441 | 3/1940 | Sandy . |
| D. 135,759 | 6/1943 | Wiljamaa . |
| D. 136,188 | 8/1943 | Payne . |
| 198,678 | 12/1877 | Poole . |
| D. 255,539 | 6/1980 | Graham . |
| D. 327,208 | 6/1992 | Wehling . |
| D. 335,806 | 5/1993 | Visic . |
| 460,438 | 9/1891 | Haunty . |
| 460,704 | 10/1891 | Hansen . |
| 464,860 | 12/1891 | Duvall . |
| 467,025 | 1/1892 | Wreden . |
| 522,904 | 7/1894 | Krank . |
| 556,644 | 3/1896 | Rivard . |
| 562,260 | 6/1896 | Toquet . |
| 611,537 | 9/1898 | Ward . |
| 1,048,753 | 12/1912 | Von den Steinen . |
| 1,227,372 | 5/1917 | Bledsoe . |
| 1,321,777 | 11/1919 | Stepanian . |
| 1,459,531 | 6/1923 | Hanson . |
| 1,472,312 | 10/1923 | Singer . |
| 1,472,517 | 10/1923 | Fry . |
| 1,485,318 | 2/1924 | Way . |
| 1,522,695 | 1/1925 | Noreen . |
| 1,558,399 | 10/1925 | Rylen . |
| 1,639,183 | 8/1927 | Ingram . |
| 2,274,945 | 3/1942 | Van Keuren . |
| 2,766,647 | 10/1956 | Patrick . |
| 2,818,758 | 1/1958 | Swanstrom et al. . |
| 2,819,633 | 1/1958 | Boehnke . |
| 3,946,453 | 3/1976 | Torres . |
| 4,023,450 | 5/1977 | Ygfors . |
| 4,651,598 | 3/1987 | Warheit . |
| 4,662,252 | 5/1987 | Warheit . |
| 4,738,169 | 4/1988 | Wyka . |
| 4,802,390 | 2/1989 | Warheit . |
| 4,907,477 | 3/1990 | Farber . |
| 4,995,128 | 2/1991 | Montgomery et al. . |
| 5,020,399 | 6/1991 | Annis et al. . |
| 5,033,338 | 7/1991 | Ford, Jr. . |
| 5,060,543 | 10/1991 | Warheit . |
| 5,062,328 | 11/1991 | Demurger . |
| 5,172,614 | 12/1992 | Monnet et al. . |
| 5,176,048 | 1/1993 | Jore et al. . |
| 5,245,721 | 9/1993 | Lowe et al. . |
| 5,249,490 | 10/1993 | Kennel . |
| 5,259,277 | 11/1993 | Zurbuchen . |
| 5,327,602 | 7/1994 | Stenger . |
| 5,351,584 | 10/1994 | Warheit . |
| 5,394,773 | 3/1995 | Zurbuchen . |
| 5,432,968 | 7/1995 | Beck . |
| 5,448,932 | 9/1995 | Zurbuchen et al. . |
| 5,660,089 | 8/1997 | Chow . |

FOREIGN PATENT DOCUMENTS

| | | |
|---|---|---|
| 887557 | of 0000 | Jordan . |

*Primary Examiner*—David A. Scherbel
*Assistant Examiner*—Anthony Ojini
*Attorney, Agent, or Firm*—Pillsbury Madison & Sutro LLP

[57] ABSTRACT

A pliers comprises a pair of elongated members having jaw portions, handle portions, and neck portions therebetween with the neck portions overlying each other and the jaw portions thereof having opposed clamping faces. One of the elongated members has a slot in its neck portion angled toward the handle portion from an imaginary line extending between the clamping faces, and a boss on the rear surface of its neck portion adjacent the imaginary line which abuts a shoulder on the rear surface of the neck portion of the other elongated member. The elongated members of the pliers may be fabricated as laminates of sheet metal elements. The boss/shoulder abutment provides a first pivot, and a pivot pin is movable from the end of the slot adjacent the imaginary line during opening of the jaws to abut the other end of the slot to provide a second pivot.

12 Claims, 3 Drawing Sheets

A
A

PLIERS (1)

BACKGROUND OF THE INVENTION

The present invention relates to pliers in which the two elongated elements of the pliers are pivotable about a pair of pivot points to provide improved clamping action.

Pliers are conventionally comprised of a pair of elongated members with jaws at one end and handle portions at the other end. In some instances, the pivot for the two jaws is fixed and in other instances, a pivot pin is slidable in a slot to allow some translation of the members relative to each other in an effort to improve the gripping orientation of the jaw portions of the pliers in what is known as a slip-joint structure. Exemplary of a slip-joint pliers is Patrick U.S. Pat. No. 2,766,647. More recently, there have been substantial efforts to provide self-adjusting pliers such as illustrated in Warheit U.S. Pat. Nos. 4,662,252 and 5,060,543.

In Jore et al U.S. Pat. No. 5,176,048 there is proposed a pliers construction in which there is not only a first pivot point but also a cam surface in which a second pivot pin is moved to effect parallel movement of the jaw faces.

It is conventional to employ offsetting of the neck portions to allow the neck portions to pivot and slide relative to one another while maintaining the jaws in opposing relationship for gripping of workpieces therebetween. To avoid the necessity for producing such offset jaw portions, some patents propose the construction of pliers with laminated jaw portions to provide opposing clamping faces such as, for example, Warheit U.S. Pat. Nos. 4,662,252 and 5,351,584.

It is an object of the present invention to provide a novel pliers employing a pair of spaced pivots about which the jaw portions pivot to enable rapid adjustment and application of high clamping force to a gripped workpiece.

It is also an object to provide such a pliers which can be quickly and readily fabricated.

Another object is to provide such pliers in which the elongated elements are laminates of multiple sheet metal parts.

SUMMARY OF THE INVENTION

It has now been found that the foregoing and related objects may be readily attained in a pliers having a first and second elongated members with a jaw portion at one end, a handle portion at the other end and a neck portion therebetween, and the neck portions of the elongated members overlie each other and the jaw portions thereof have opposed clamping faces in abutting relationship. The neck portion of one of the members has a slot therein extending at an angle towards the longitudinal axis of the handle portion thereof and also has a boss on the rearward surface thereof extending behind the neck portion of the other of the elongated members. The rearward surface of the neck portion of the other elongated member has a shoulder thereon spaced from the handle portion thereof against which the boss abuts in the abutting position of the jaw portions and A pivot pin is seated in the neck portion of the other elongated member and extends in the slot, and the neck portions of the elongated members are slidable relative to each other with the pivot pin sliding in the slot when the handle portions are pivoted relative to each other to open and close the jaw portions.

Generally, the neck portions of the elongated members are offset from the planes of the handle portions thereof to overlie each other. Preferably, the rear surface of the neck portion of the other elongated member has a substantially rectilinear section originating at the shoulder and extending at an angle inclined towards the jaw portion thereof.

Desirably, each of the jaw portions of the elongated members is a laminate with an elongated element providing the handle portion, jaw portion and offset neck portion. At least one jaw laminate element overlies and is secured to the jaw portion of the elongated element to provide an abutting clamping surface cooperating with the clamping surface of the elongated element of the other elongated member.

Preferably, the slot is disposed substantially to one side of an imaginary line extending between the clamping faces of the jaw portions and the shoulder is disposed to the other side of the imaginary line. The pivot pin is disposed along the imaginary line.

DETAILED DESCRIPTION OF THE ILLUSTRATED EMBODIMENT

Figures 1, 2, 3, 4:
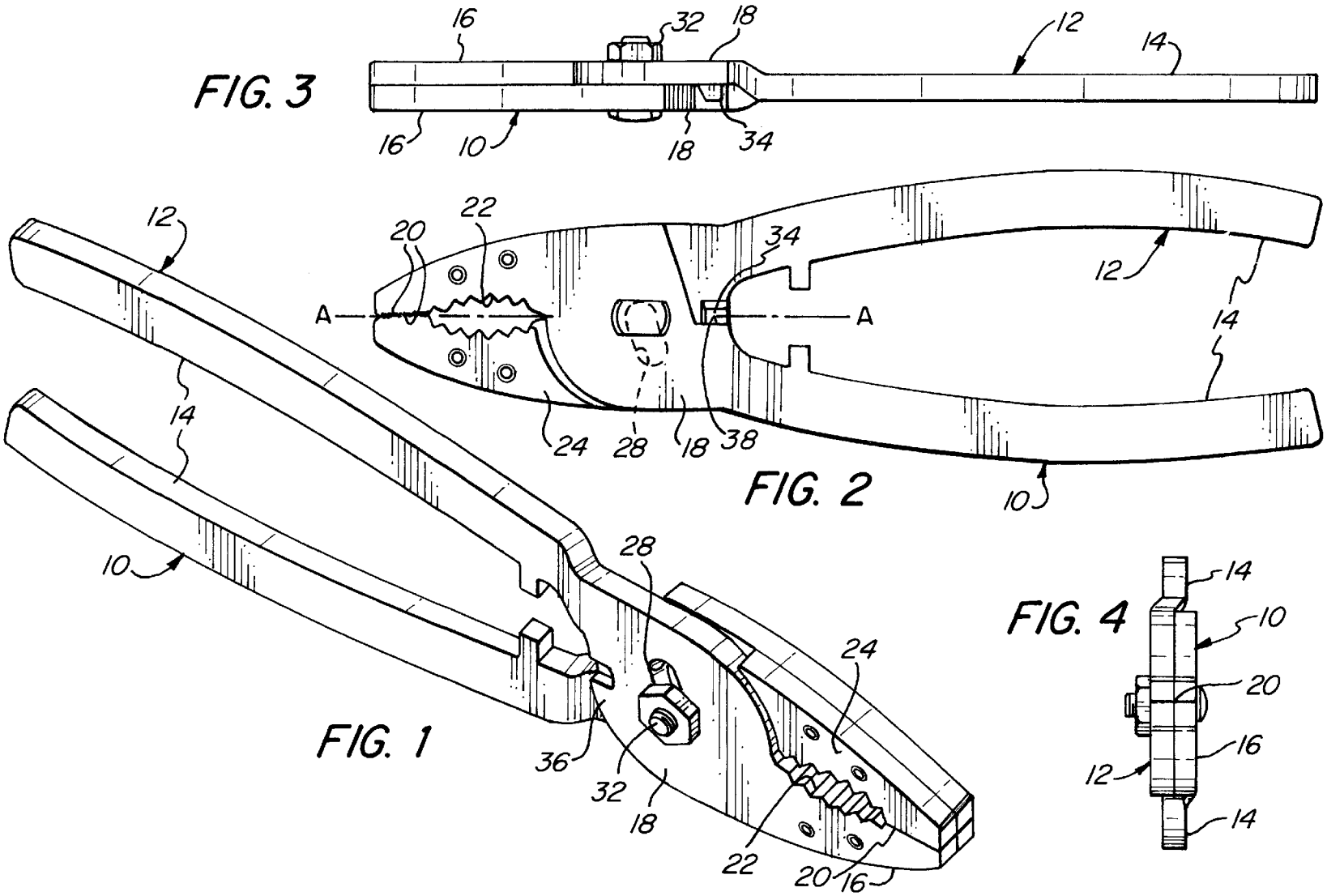
FIG. 1 is a perspective view of pliers embodying the present invention with the jaw portions in a closed position.
FIG. 2 is a plan view thereof with the slot in one elongated member shown in phantom line.
FIG. 3 is a side elevational view thereof.
FIG. 4 is an elevational view of the jaw end thereof.
Figure 5:
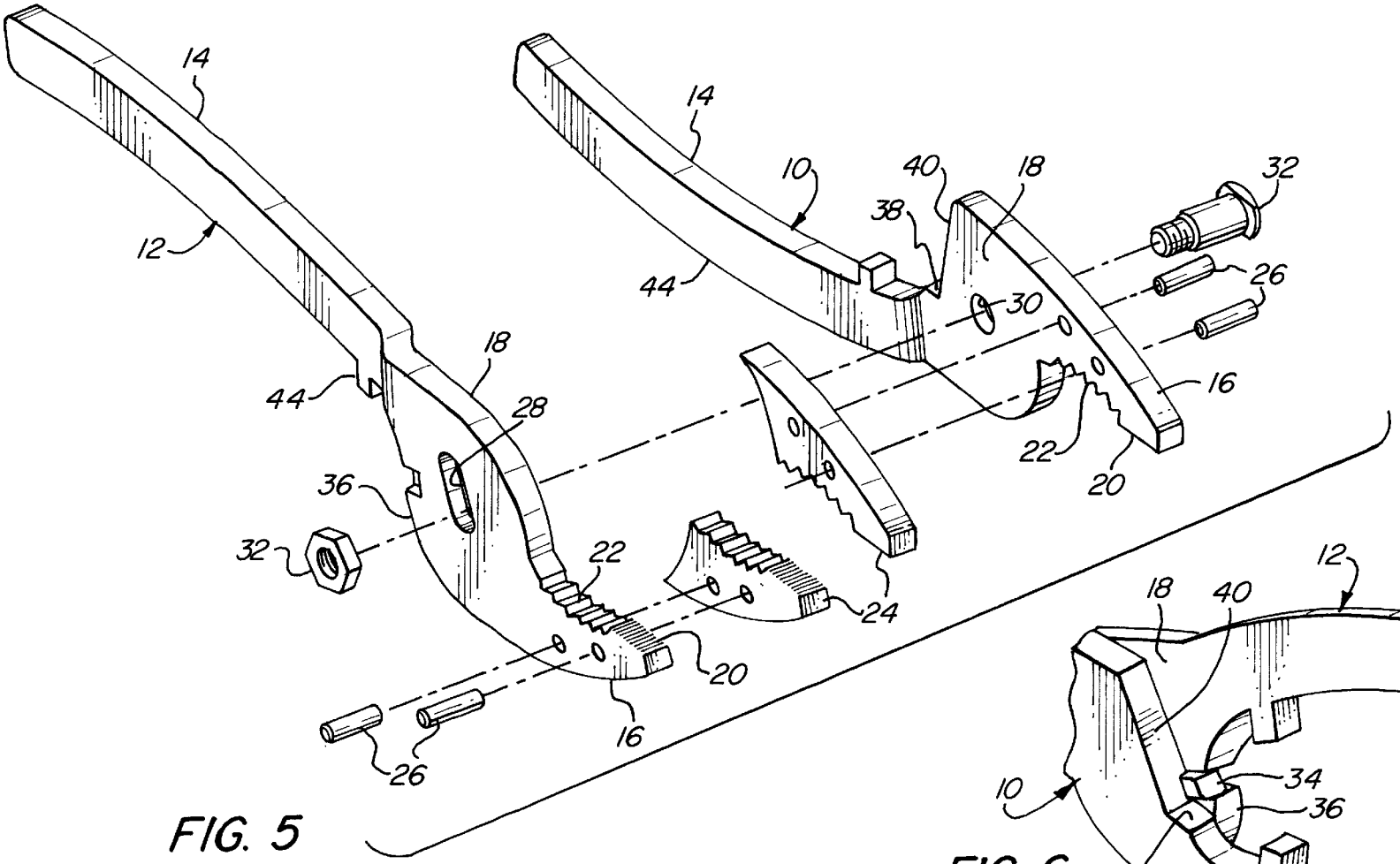
FIG. 5 is an exploded view thereof.
Figure 6:
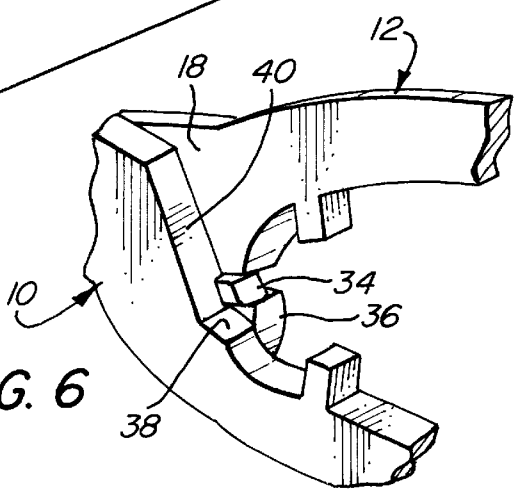
FIG. 6 is a fragmentary perspective view showing the rear surface of the neck portion with the boss on one member abutting the shoulder on the other member.

Turning first to FIG. 1, a pliers embodying the present invention is comprised of a pair of elongated laminated members generally designated by the numerals 10,12. Each has an elongated handle portion 14 at one end, a jaw portion 16 at the other end and a neck portion 20 therebetween. The jaw portions 16 have clamping faces 18 which, when closed, extend in a common plane adjacent their outer ends and have diverging arcuate portions 22 spaced from the outer ends.

The elongated members 10, 12 are each comprised of an elongated metal laminate element 44 and a laminate jaw element 24 provided in the jaw portion 16 of the elongated members 10, 12 so as to provide abutting clamping surfaces 20. The laminate elements 42, 24 are secured in assembly to the elongated elements 44 by rivets 26.

As best seen in FIG. 2, the elongated member 12 has a rectilinear slot 28 formed in its neck portion 18 intermediate its length, and the elongated member 10 has an aperture 30 formed therein in which is fixed a pivot fastener 32 comprised of a machine screw and nut, and the shank of the screw extends through the slot 28 and is slidably seated therein. The slot 28 extends at an angle in the direction of the handle portion 14 of the member 12 from the imaginary line A—A, which is an extension of the plane of the generally rectilinear outer portion of the clamping faces 20 of the jaw portions 16.

The pivot aperture 30 is located along the imaginary line A—A, and the shoulder 38 is located adjacent, but a small distance to the opposite side of, the imaginary line A—A from the principal length of the slot 28. The slot 28 extends a short distance beyond the imaginary line A—A to allow the boss 34 to seat against the shoulder 38 in the fully closed position of the jaw portions 16.

Turning now to FIGS. 7–10, the operation of the double pivot arrangement of the present invention is illustrated diagrammatically therein.

Figure 7:
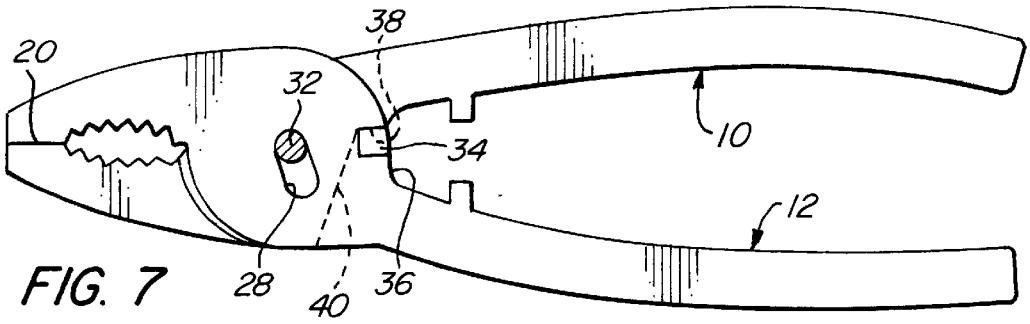
FIG. 7 is a plan view of the side of the pliers opposite from that in FIG. 2 showing the rear surface of the neck portion of one member in phantom line.

As seen in FIG. 7, when the pliers is in its fully closed position, the pivot fastener 32 is seated at the end of the slot 28, substantially along the imaginary line A—A, and the boss 34 is seated against the shoulder 38.

Figure 8:
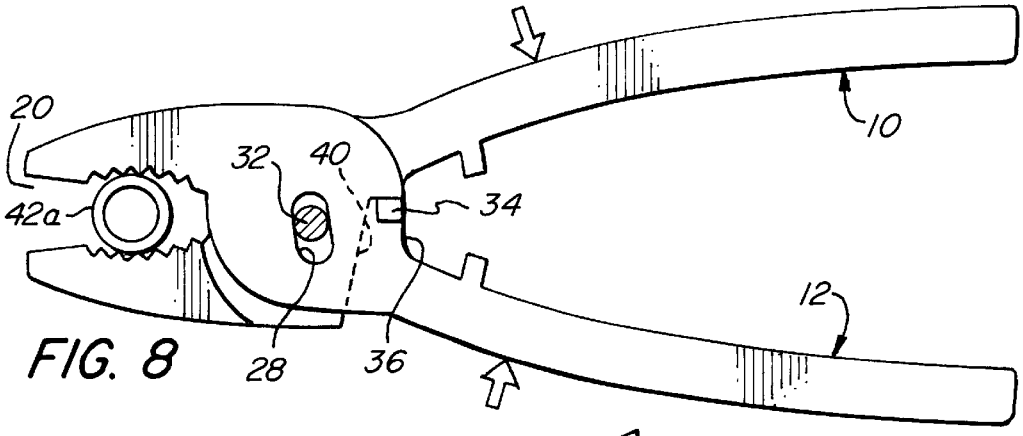
FIG. 8 is a similar diagrammatic view showing the plier members with the jaws in a partially opened position with a relatively small workpiece gripped therebetween.

As seen in FIG. 8, when the elongated members 10,12 are pivoted apart to open the jaw portions 16 to receive a relatively small diameter workpiece 42*a* in the arcuate portions of the clamping faces 20, the members 10, 12 pivot about the abutment of the boss 34 and shoulder 38 while the pivot fastener 32 moves in the slot 28.

Figure 9:
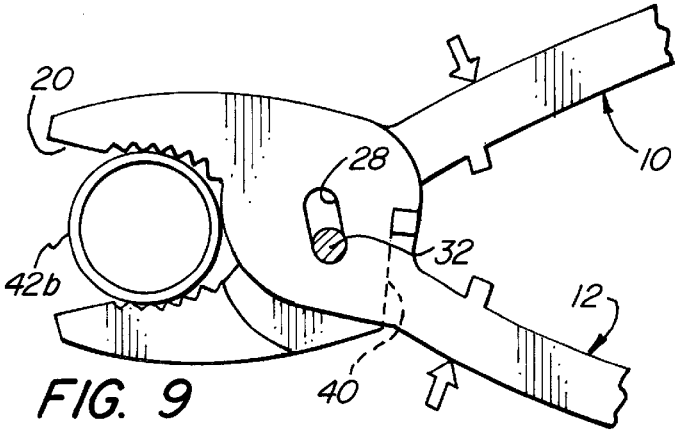
FIG. 9 is a similar fragmentary view showing the jaws in a further opened position gripping a larger workpiece.

As seen in FIG. 9, opening of the jaw portions 16 still further to seat the larger diameter workpiece 42*b* causes the pivot fastener 32 to move to the end of the slot 28 while the boss 34 remains in abutment with the shoulder 38.

Figure 10:
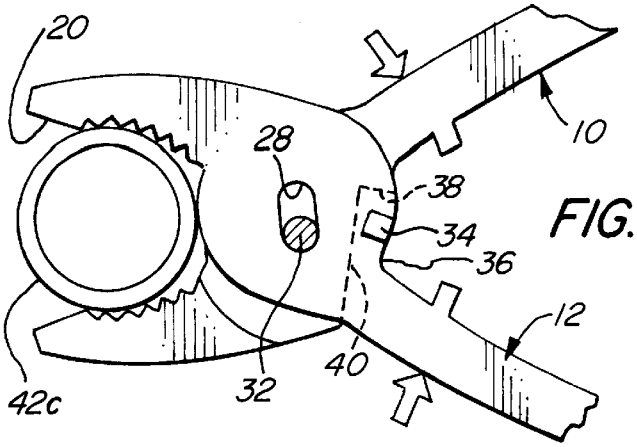
FIG. 10 is a similar fragmentary view with the jaws in a full open position to grip a still larger workpiece.

As seen in FIG. 10, opening of the jaw portions 16 still further to seat the larger diameter workpiece 42*c* now causes the elongated member 12 to pivot about the pivot pin 32 as the boss 34 moves away from the shoulder 38.

Thus, it can be seen that there is a firm pivot at all positions of the jaw portions and a high degree of clamping force can be applied upon the gripped workpiece.

As will be readily appreciated, other configurations for the handle portion of the elongated members may be employed. Moreover, multiple elongated elements of sheet metal may be employed for each of the elongated members as well as for the jaw portions.

In addition to the illustrated slip joint pliers embodiment, the present invention may be utilized in other types of pliers employing similar jaw action including needle nose, linesman, wire cutters and water pump.

In practice, it has been found advantageous to mold a synthetic resin grip about both handle portions to provide a comfortable gripping surface. In molding of the grip, a first resin of relatively rigid nature may be molded about the metal members and then a more resilient resin molded thereover.

The shape of the clamping surfaces of the jaws can also vary considerably depending upon the application for the pliers. The clamping faces are conveniently provided with teeth or serrations to facilitate gripping of the workpiece. Alternatively, they can be provided with a friction enhancing hard metallic surface deposit.

As will be readily appreciated, the laminate elements can be formed conveniently from the sheet metal in a stamping operation and assembled quickly and conveniently by simple riveting operations.

Thus, it can be readily seen from the foregoing detailed description and attached drawings that the pliers of the present invention provides a novel two pivot structure enabling facile adjustment of the spacing between the clamping faces and effective transfer of the force applied to the handles to the clamping surfaces of the jaws to grip firmly a workpiece between. The pliers can be readily fabricated from inexpensive sheet metal to provide the structural elements which may then be assembled quickly and economically.

Having thus described the invention, what is claimed is:

1. A pliers comprising;

(a) a first elongated member having a jaw portion at one end, a handle portion at the other end and a neck portion therebetween;

(b) a second elongated member having a jaw portion at one end, a handle portion at the other end and a neck portion therebetween, said neck portions of said elongated members overlying each other and said jaw portions thereof having opposed clamping faces in abutting relationship, the neck portion of one of said elongated members having a slot therein extending at an acute angle towards the longitudinal axis of said handle portion thereof and a boss on the rearward edge thereof extending behind said neck portion of the other of said elongated members, the rearward surface of said neck portion of said other elongated member having a shoulder thereon spaced from the handle portion thereof against which said boss abuts in the abutting position of said jaw portions; and (c) a pivot pin seated in said neck portion of said other elongated member in a fixed position on said other elongated member and slidably extending in said slot of said one elongated member, said neck portions of said elongated members being slidable relative to each other with said pivot pin sliding in said slot of said one elongated member when said handle portions are pivoted relative to each other to open and close said jaw portions.

2. The pliers in accordance with claim 1 wherein said neck portions of said elongated members are offset from the planes of said handle portions thereof to overlie each other.

3. The pliers in accordance with claim 1 wherein said rear edge of said neck portion of said other elongated member has a substantially rectilinear section originating at the shoulder and extending at an angle inclined towards said jaw portion thereof.

4. The pliers in accordance with claim 1 wherein each of said jaw portions of said elongated members is a laminate.

5. The pliers in accordance with claim 4 wherein each of said elongated members includes an elongated element providing said handle portion, jaw portion and offset neck portion and at least one jaw element overlying and secured to said jaw portion thereof to provide an abutting clamping face cooperating with the clamping face of the elongated element of the other elongated member.

6. The pliers in accordance with claim 1 wherein said slot is disposed substantially to one side of an imaginary line extending between the clamping faces of said jaw portions and said shoulder is disposed to the other side of said imaginary line.

7. The pliers in accordance with claim 6 wherein said pivot pin is disposed along said imaginary line.

8. The pliers in accordance with claim 1 wherein said rear edge of said neck portion of said other elongated member includes a rectilinear portion extending from said shoulder in a direction opposite to that of said slot.

9. The pliers in accordance with claim 1 wherein said rear edge of said neck portion of said other elongated member includes a rectilinear portion extending from said shoulder in a direction opposite to that of said slot.

10. The pliers in accordance with claim 1 wherein said neck portions of said elongated members are offset from the planes of said handle portions thereof to overlie each other.

11. A pliers comprising:

(a) a first elongated member having a jaw portion at one end, a handle portion at the other end and a neck portion therebetween;

(b) a second elongated member having a jaw portion at one end, a handle portion at the other end and a neck portion therebetween, said neck portions of said elongated members overlying each other and said jaw portions thereof having opposed clamping faces in abutting relationship, the neck portion of one of said elongated members having a slot therein extending at an acute angle towards the longitudinal axis of said handle portion thereof and a boss on the rearward edge thereof extending behind said neck portion of the other of said elongated members, said slot being disposed substantially to one side of an imaginary line extending between the clamping faces of said jaw portions, the rearward edge of said neck portion of said other elongated member having a shoulder thereon spaced from the handle portion thereof and against which said boss abuts in the abutting position of said jaw portions, said shoulder being disposed to the other side of said imaginary line; and (c) a pivot pin seated in said neck portion of said other elongated member in a fixed position on said other elongated member along said imaginary line and slidably extending in said slot of said one elongated member, said neck portions of said elongated members being slidable relative to each other with said pivot pin sliding in said slot of said one elongated member when said handle portions are pivoted relative to each other to open and close said jaw portions.

12. The pliers in accordance with claim 11 wherein each of said jaw portions of said elongated members is a laminate, each of said elongated members includes an elongated element providing said handle portion, jaw portion and offset neck portion and at least one jaw element overlying and secured to said jaw portion thereof to provide an abutting clamping face cooperating with the clamping face of the elongated element of the other elongated member.

* * * * *